US005289852A

United States Patent [19]

Migliorini et al.

[11] Patent Number: 5,289,852

[45] Date of Patent: Mar. 1, 1994

[54] REED FOR TEXTILE MACHINES

[75] Inventors: Lorenzo P. Migliorini, Bracciolini; Pier C. Molta, Prato; Giorgio Torelli, Pisa, all of Italy

[73] Assignee: Tecnotessile Centro di Richerche S.r.l., Florence, Italy

[21] Appl. No.: 957,523

[22] Filed: Oct. 6, 1992

[51] Int. Cl.[5] ..... D03D 49/62

[52] U.S. Cl. ..... 139/192; 28/204

[58] Field of Search ..... 139/30, 31, 32, 33, 139/188 A, 189, 190, 191, 192, 93; 28/204, 205, 206, 207

[56] References Cited

U.S. PATENT DOCUMENTS

| | | | |
|---|---|---|---|
| 848,875 | 4/1907 | Bates | 139/191 |
| 982,862 | 1/1911 | Peterson | 139/191 |
| 1,970,175 | 8/1934 | Kaufmann | 139/93 |
| 4,074,726 | 2/1978 | Harris | 139/29 |
| 4,160,467 | 7/1979 | Woodruff | 139/33 |
| 4,378,820 | 4/1983 | Lileev et al. | 139/192 |
| 4,694,867 | 9/1987 | Gendelman et al. | 139/192 |
| 5,086,810 | 2/1992 | Carroll | 139/1 C |

FOREIGN PATENT DOCUMENTS

| | | | |
|---|---|---|---|
| 61-39422 | 9/1986 | Japan | 139/192 |

*Primary Examiner*—Andrew M. Falik

*Attorney, Agent, or Firm*—McGlew and Tuttle

[57] ABSTRACT

Reed for textile machines comprising a plurality of vertical dents or teeth (2) each made of a metal sheet with the lower end fastened to a base crosspiece (1), while the upper end of the dents (2) is free and the profile of each dent (2) is shaped to form one or more recesses (3) staggered heightwise between adjacent dents (2).

16 Claims, 3 Drawing Sheets

REED FOR TEXTILE MACHINES

FIELD OF THE INVENTION

The present invention refers to a reed for a textile machine.

As is known in the art, the reed is a comb-like assembly of flat, parallel, equidistant strips called "dents" or teeth. The loom and warper reeds are enclosed in a frame having sides mostly made of wood or metal.

It is also known that the passage of threads across the reed dents is carried out either manually or mechanically by using a hooked implement called a "heddle tool" which is pushed and then withdrawn between one dent and the other in the warp direction.

SUMMARY AND OBJECTS OF THE INVENTION

The present invention has the object to provide a reed adapted for mechanical selection.

This result has been achieved, according to the invention, by making a reed open on top. Moreover, in order to prevent the various dents from moving close to or away from each other during the work, provision is made to have a portion close to the free end of each dent suitably shaped so as to form at least an abutment between one dent and the other.

The advantages obtained from the present invention lie essentially in that it is possible to perform the reeding both by following the traditional procedure and by introducing the threads from the open upper side, and then making them slide downwards along the sides of the reeds; that it is possible to operate a dent-by-dent selection, mechanically and automatically, by means of a selector able to selectively and sequentially retract every single dent sideway; that a reed according to the invention is easily transformable into a closed reed, easy to make and of extreme reliability.

BRIEF DESCRIPTION OF THE DRAWINGS

These and further advantages and characteristics of the invention will be best understood by any skilled in the field from a reading of the following description in conjunction with the attached drawings given only as a practical exemplification of the invention, but not to be considered in a limiting sense; in which.

DETAILED DESCRIPTION OF THE PREFERRED EMBODIMENTS

Figure 1:
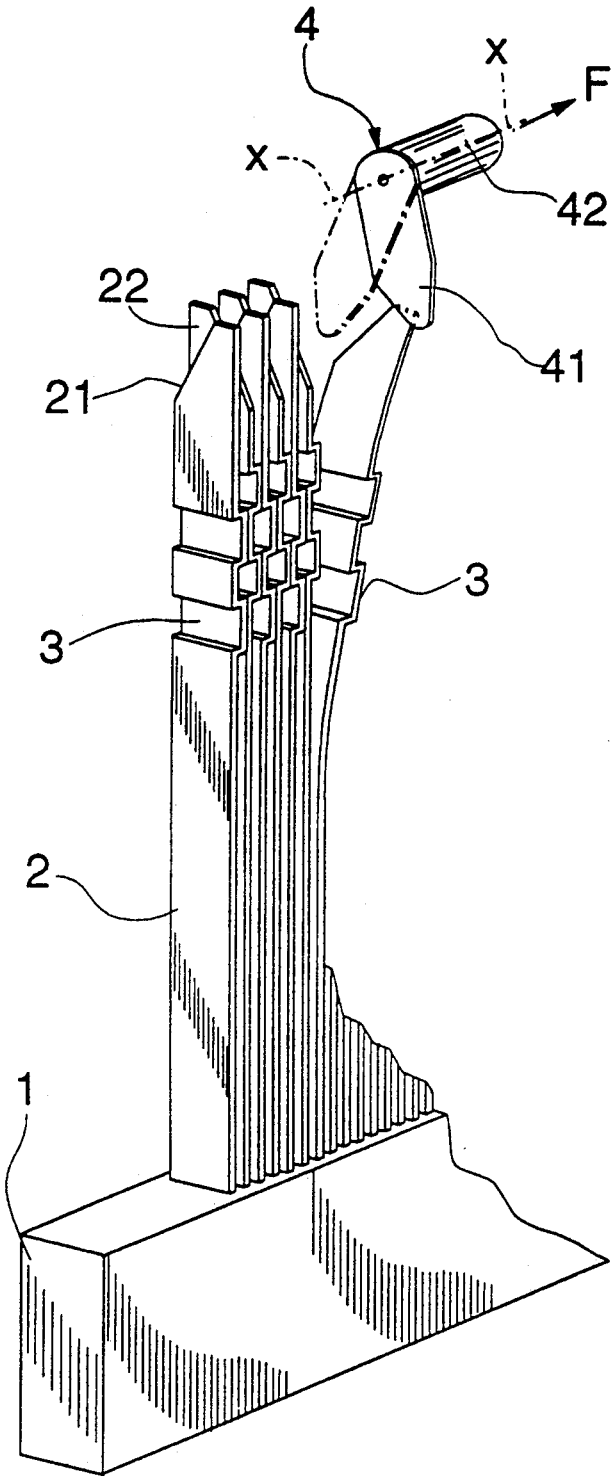
FIG. 1 is a fragmentary, axonometric side view of a reed according to the invention with a generic selector device on top shown in its two working positions.

Reduced to its basic structure and with reference to the attached drawings, a reed for textile machines, according to the invention, comprises a wood base 1, from the top face of which a plurality of dents 2 are made to project parallel to each other, each dent consisting of a metal strip whose lower end is fixed to the base 1 while the upper end is free.

Close to its free end, each dent is die-shaped so as to form two transversal recesses 3 whose depth is equal to the space between the dents, and which extend throughout the width of the strip thereby forming a unilaterally corrugated profile with respect to the axial longitudinal plane of the dent.

The same profile is repeated at the same level every other dent and with a height staggering between adjacent dents over an extent equal to the height of same dents 3.

With such a shape, each dent 2 of the reed results in contact with the adjacent one over the extension of the two recesses 3, so as to ensure a constant spacing between the dents.

Figure 2A:
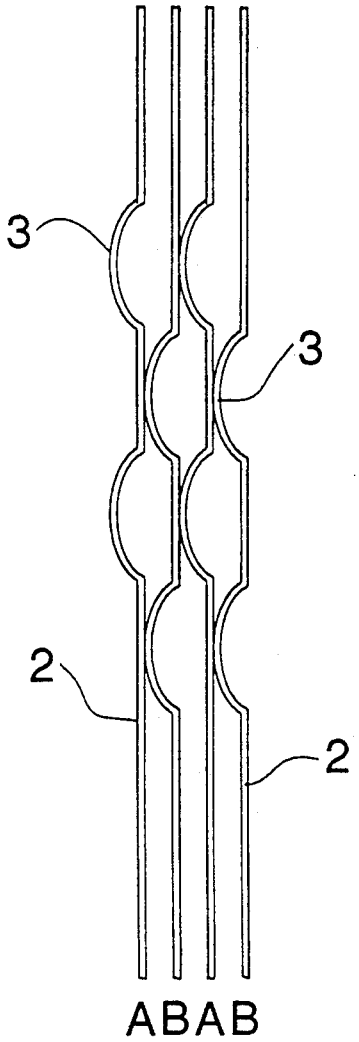
FIGS. 2A–2B–2C show the detail of three possible dent profiles for the reed of FIG. 1.
Figure 2B:
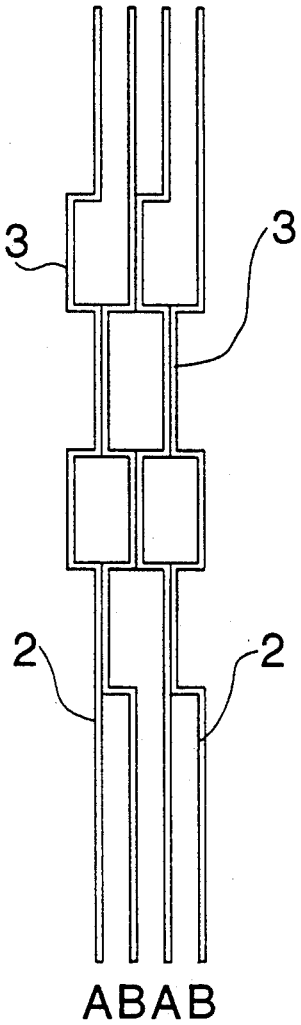
Figure 2C:
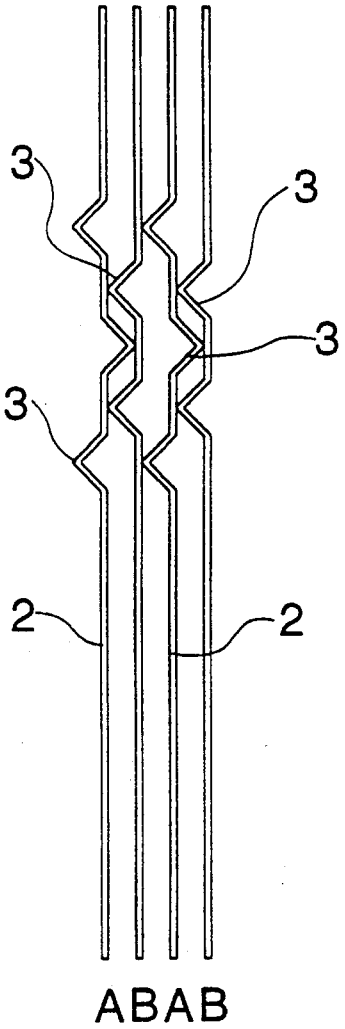
Figure 4:
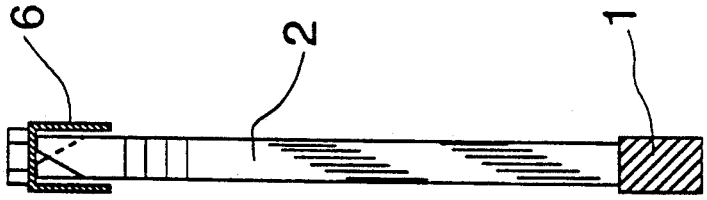
FIG. 4 is the cross-section taken on line 4—4 in FIG. 3.
Figure 3:
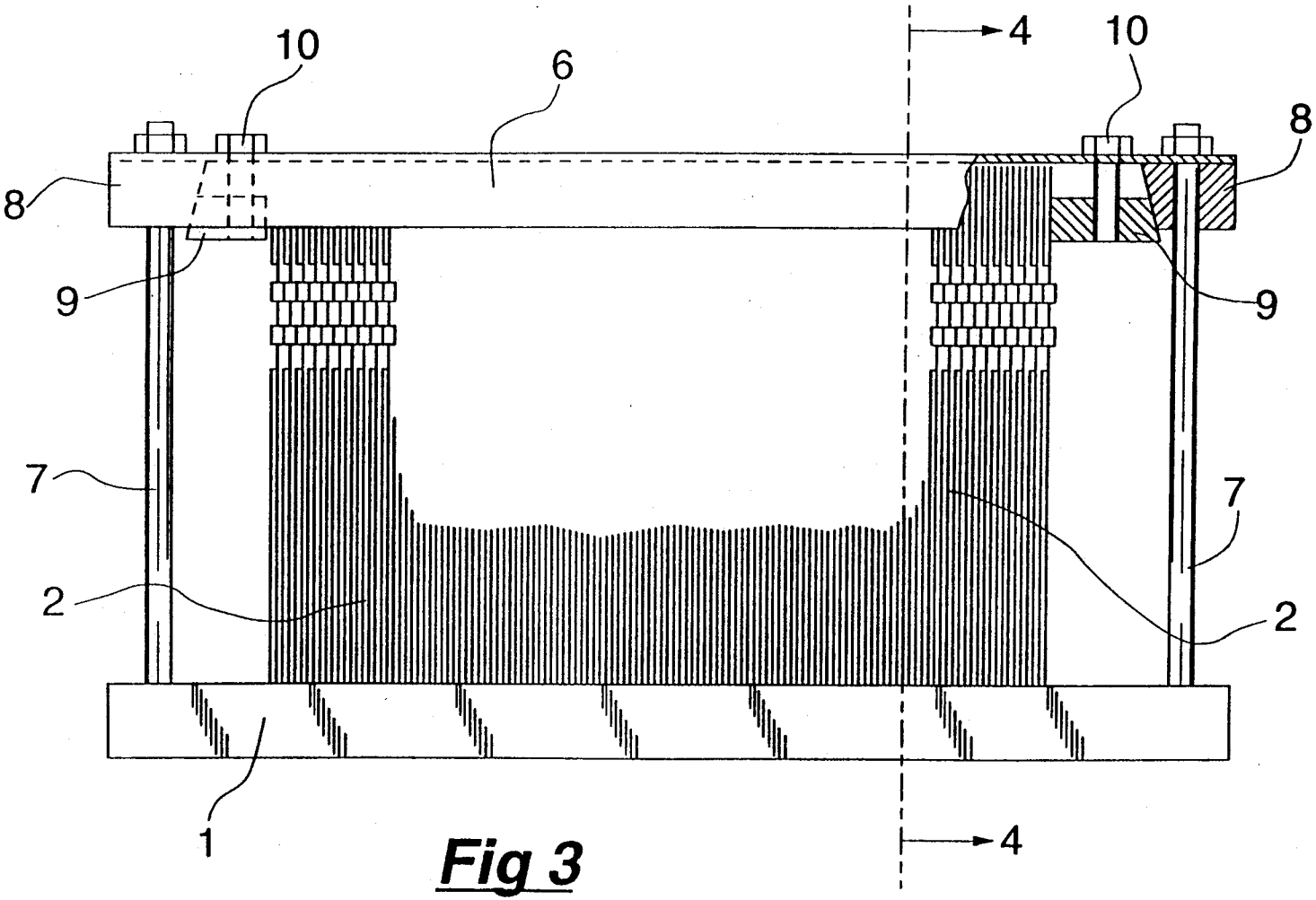
FIG. 3 is a front view of the "close" type reed of FIG. 1.

The above recesses may take up different profiles among which FIGS. 2A, 2B, 2C are three feasible embodiments, and in which FIG. 2A shows a curvilinear profile, FIG. 2B shows a corrugated profile like the one of the reed of FIG. 1, and FIG. 2C shows a cuspate profile.

Moreover, the free end of dents 2 is advantageously cut so as to slant down outwardly to form a chamfer 21 which is alternatively repeated on the opposite side in the adjacent dents, so that the chamfer of one dent will correspond—in the reed longitudinal direction—to the solid part 22 of the adjacent dent.

The particular, above indicated chamfered upper free end 21 of the reed dents 2 allows a mechanical and automatic dent-by-dent divarication to facilitate the passing of threads, which is performed by placing them transversally above or astride the reed and then making them slide downwards between the dents.

This mechanical divarication is accomplished by means of a selector device generally designated 4 which includes a shaft 42 moving alternatively about its own axis, and intermittently along an axis xx parallel to the longitudinal axis of the reed and located above the dents 2, said shaft being solid to a trasversal rocker 41 whose downwardly directed free end is chamfered on both sides. Owing to the oscillating motion of the shaft 42, the rocker 41 swings to and fro between two positions, an active one (shown in solid line in FIG. 1) in which the tip thereof results juxtaposed to the solid part 22 of the free end of each dent 2, and a passive one (shown in dotted line in FIG. 1) in which said tip of rocker 41 matches the chamfered part 21 of the same dent.

When in said active position, and owing to its translation motion in the direction of arrow F, the rocker engages one reed and bends it away from the preceding one; when the rocker revolves on its own axis without translation and reaches said resting position, it releases the retracted dent, which can thus move elastically back into the vertical position, and the rocker moves past said dent; afterwards, the rocker, by revolving on its own axis in the opposite direction, moves to the active position causing the subsequent dent to retract in the same way as described above.

Advantageously, it is possible, according to the invention, to transform the reed from "open" to "closed" by means of an upper crosspiece 6 fastened to the base 1 through two brackets 7 having the same height as dents 2 and located sideway of the latter. Said crosspiece 6 is shaped as an inverted U so as to include, over a substantial central extension thereof, the free ends of dents 2 and laterally, in correspondence of the points where the brackets 7 go therethrough, two shoes 8 shaped like a rectangular trapezium having the inclined side directed inwardly to the reed. In this condition, the stiffening of the structure may be achieved through two wedges 9 inserted between the upper end of the lateral dents and the inclined side of the shoes 8, said wedges being recalled upwards by a screw 10 which goes through the crosspiece 6 and operates the tightening.

Practically, all the construction details may vary in any equivalent way as far as the form, dimensions, elements disposition, nature of the used materials are concerned, without nevertheless departing from the scope of the adopted solution idea and, thereby, remaining within the limits of the protection granted to the present patent for industrial invention.

We claim:

1. A reed for textile machines, comprising: a base crosspiece, a plurality of vertical teeth with a lower end fastened to said base crosspiece, said teeth having an upper free end adapted for engagement with a mechanical selection means and having a profile with one or more transversely extending recesses located near said free end, said profile being staggered heightwise between adjacent teeth, said one or more recesses having a depth for contact with an adjacent tooth over the extension of said recess equal to a spacing between adjacent teeth.

2. A reed according to claim 1, wherein said upper end of each of said teeth is provided with inclined lateral chamfer, adjacent teeth having said chamfer alternately on one side and the other with respect to a longitudinal axial plane of the reed.

3. A reed according to claim 1, wherein said one or more recesses on each of said teeth are located on a same side of a longitudinal axis of each of said teeth.

4. A reed according to claim 1, wherein said one or more recesses of said teeth are located on each of two sides of a longitudinal axis of said teeth.

5. A reed according to claim 9, wherein said one or more recesses have a profile which is curvilinear.

6. A reed according to claim 1, wherein said one or more recesses have a profile which is corrugated.

7. A reed according to claim 1, wherein said one or more recesses have a profile which is cuspate.

8. A reed according to claim 1, further comprising a moveable upper crosspiece having an inverted U profile, said crosspiece being positioned to overlap said upper ends of said teeth, said upper crosspiece being provided with two side brackets for connection of said upper crosspiece with said base crosspiece, and further including wedge means for stiffening said teeth, said base crosspiece and said upper crosspiece.

9. A reed for textile machines, comprising: a base crosspiece; a plurality of vertical dents with a lower end fastened to said base crosspiece, said dents having an upper free end adapted for engagement with a mechanical selection means and having a profile with one or more transversely extending recesses located near said free end, said profile being staggered heightwise between adjacent dents, said recess having a depth equal to a spacing between adjacent dents for contact with an adjacent dent over the extension of said recess.

10. A reed according to claim 9, wherein said upper end of each of said dents is provided with inclined lateral chamfer, adjacent dents having said chamfer alternately on one side and the other with respect to a longitudinal axial plane of the reed.

11. A reed according to claim 9, wherein said recess on each of said dents is located on a same side of a longitudinal axis of each of said dents.

12. A reed according to claim 9, wherein said recess of said dents is located on each of two sides of a longitudinal axis of said dents.

13. A reed according to claim 9, wherein said recess has a profile which is curvilinear.

14. A reed according to claim 9, wherein said recess has a profile which is corrugated.

15. A reed according to claim 9, wherein said recess has a profile which is cuspate.

16. A reed according to claim 9, further comprising a moveable upper crosspiece having an inverted U profile, said crosspiece being positioned to overlap said upper ends of said dents, said upper crosspiece being provided with two side brackets for connection of said upper crosspiece with said base crosspiece, and further including wedge means for stiffening said dents, said base crosspiece and said upper crosspiece.

* * * * *

UNITED STATES PATENT AND TRADEMARK OFFICE

CERTIFICATE OF CORRECTION

PATENT NO. : 5,289,852

DATED : March 1, 1994

INVENTOR(S) : Migliorini et al

It is certified that error appears in the above-identified patent and that said Letters Patent is hereby corrected as shown below:

On the title page of the Letters Patent, please correct the spelling of the first named inventor in item 75 as follows:

Pier L. Migliorini

Signed and Sealed this

Twenty-sixth Day of July, 1994

*Attest:*

*Attesting Officer*

BRUCE LEHMAN

*Commissioner of Patents and Trademarks*